US005190063A

United States Patent [19]

Urcola

[11] Patent Number: 5,190,063

[45] Date of Patent: Mar. 2, 1993

[54] MACHINES FOR WASHING BOTTLES OR THE LIKE

[76] Inventor: Antonio M. Urcola, Independencia N° 2240, Buenos Aires, Argentina

[21] Appl. No.: 732,048

[22] Filed: Jul. 18, 1991

[30] Foreign Application Priority Data

Aug. 8, 1990 [AR] Argentina ..... 317.564

[51] Int. Cl.[5] ..... B08B 3/10

[52] U.S. Cl. ..... 134/60; 134/73; 134/131; 134/170; 134/111

[58] Field of Search ..... 134/60, 131, 73, 124, 134/111, 170

[56] References Cited

U.S. PATENT DOCUMENTS 1,544,506 6/1925 Tytus ..... 134/60
2,619,097 11/1952 Von Bromssen ..... 134/57 R
3,129,712 4/1964 Thomas ..... 134/57 R
3,896,828 7/1975 Foster et al. ..... 134/60 X
4,039,349 8/1977 Kwasnoski et al. ..... 134/122 R
4,076,554 2/1978 Weihe ..... 134/60 X
4,094,329 6/1978 Evans ..... 134/60 X
4,388,120 6/1983 West et al. ..... 134/60 X

FOREIGN PATENT DOCUMENTS 54-115564 9/1979 Japan ..... 134/60

*Primary Examiner*—Frankie L. Stinson
*Attorney, Agent, or Firm*—Bachman & LaPointe

[57] ABSTRACT

Improvements in washing machines for bottles or the like, by immersing bottles into hot washing solution, wherein in the front and rear zones, at that of higher temperature, the washing solution is forced to circulate in a direction opposite to that of the movement direction of the bottles.

8 Claims, 1 Drawing Sheet

MACHINES FOR WASHING BOTTLES OR THE LIKE

FIELD OF THE INVENTION

The instant invention relates to improved machines for washing bottles or the like of the type comprising container means for receiving and conveying bottles from a loading position towards an unloading position, successively passing through a pre-washing injection or immersion step in recovered water, one or several immersion washing steps in hot caustic solution tanks, discharging the contents of the bottles at the outlet of each tank, and a rinsing step by means of injectors of recovered water ending at a final rinsing step with fresh clean water, prior to unloading.

BACKGROUND OF THE INVENTION—PRIOR ART

Technical requirements for washing bottles, flasks, etc, for containing beverages or food products should guarantee not only cleaning thereof, but also removal and elimination of germs and bacteria which may affect the products to be packed. To this end, it is basic that, at least one of the caustic soda solution tanks into which bottles are immersed be at a temperature of about 65° C. and that the machine guarantees, at its maximum operating speed, the permanence of the bottle into such tank during a minimum predetermined period of time.

Present washing machines, those having a single immersion tank as well as those having several tanks, have independent heating elements and temperature control elements for each tank which, requiring a stepwise control of the temperature in order that the thermal change when glass bottles pass from one tank to the other do not cause breakage thereof.

Operation at raising temperature step or steps offers no problems, but when operating at decreasing temperature steps, the heat released from containers and bottles when passing from a high temperature tank to one of lower temperature gradually heat the lower temperature tank, thus requiring its continuous drainage replacing the cold solution in order to maintain temperature levels. As a consequence, the energy delivered to the raising temperature tanks, generally by means of water steam, is lost when draining the tanks in the cooling step.

Another disadvantage of known washing machines is the lack of temperature uniformity in each of the tanks which, due to their large volume, do not permit temperature distribution at the same rate through the whole liquid mass and, although mechanical stirrers comprised by swivelling plates are sometimes used, a local turbulence is only attained in a small region of the tank. Thus, the maximum temperature required by standards is not attained during the proper period of time.

SUMMARY OF THE INVENTION

The basic improvement disclosed in the present invention comprises the inclusion of a forced circulation circuit of the washing solution for obtaining heat exchange between the washing solution and the bottles with their containers in countercurrent, the solution flowing from a bottle outlet zone towards the rinsing steps up to the inlet zone thereof from the pre-washing, from which said solution is taken by a pump transferring it to the starting point.

An additional improvement comprises the incorporation of a second forced circulation heating circuit, extending through the mean part of the washing machine the required dimension, in order that bottles are maintained within said zone a period of time equal or higher than that required by the standards.

In this heating circuit, the flow of the washing solution, heated at the outlet of the pump, may be made countercurrent or in the same direction of the movement direction of the containers, the second alternative being preferred, especially in machines having several tanks, since the heat solution supply is carried out at the inlet zone of the bottles such that the filling thereof is made with the solution at the desired temperature.

The flow rates passing through both circuits are adapted to the working rate of the washing machine.

The heating of the washing solution in the heating circuit may be carried out by means of steam coils located within the tank at the discharge zone of the pump, or in a heat exchanger or outside the tank, the latter being the preferred form since it allows a better control and automatic regulation of the temperature.

At the circuit of the solution flowing from the end adjacent the machine unloading zone towards the inlet thereof, said solution enters at a low temperature, being gradually heated by the heat received from bottles and their containers, from which heat is recovered, and cooling them towards its outlet to the rinsing step.

The high temperature obtained with this recovery by the solution near the heating zone reduces to a minimum the thermal change for the bottles exiting from said zone.

In a similar way, that solution heated by recovery passes to a zone adjacent the heating zone, crossing with containers and bottles coming from the machine inlet, which are heated thereby up to a temperature close to that of the heating circuit. In turn, the washing solution cools towards the inlet point of cold bottles with a small temperature difference with respect thereof, the solution being taken by the pump which transfers it to the end adjacent the unloading zone in order to re-start the cycle.

The above improvements allow reducing steam consumption in approximately 25%.

A sand filter mounted at the outlet of the pump maintaining circulation in the thermal recovery circuit cleans the washing solution before feeding it to the final part of the washing process thus avoiding pollution of the bottles near the machine unloading zone.

In machines which several immersion tanks it is convenient to use the same concentration of washing agent for the washing solution in all the tanks, assuring a broad draining zone for bottles and containers from the last pre-washing up to the inlet to the first tank, and from the outlet of the last tank up to the first rinsing operation, since these are the zones carrying water to the washing solution for acting as diluent, and carrying the solution outside the machine, respectively.

Some alternative embodiments will be described hereinbelow, as non limiting examples.

BRIEF DESCRIPTION OF THE DRAWINGS

In both figures, the same reference numerals designate the same or equivalent parts.

DETAILED DESCRIPTION OF THE INVENTION

Figure 1:
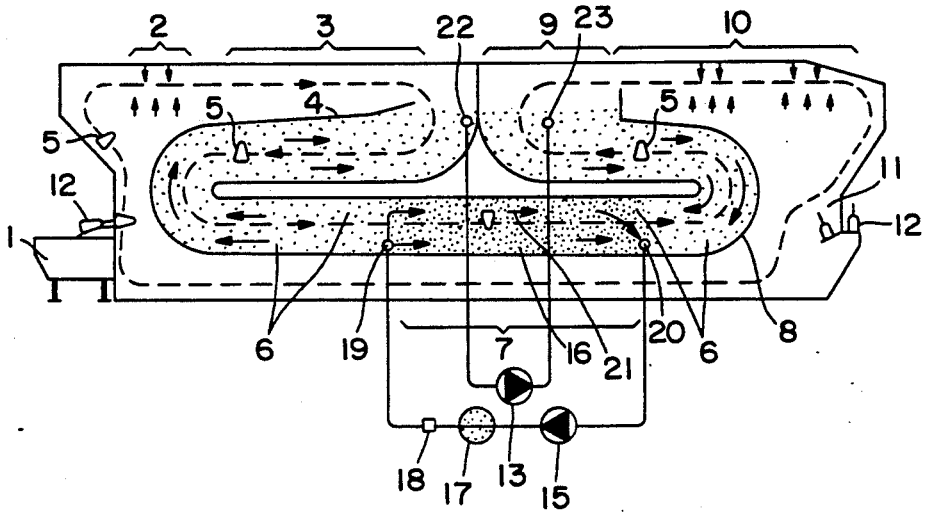
FIG. 1 is a schematic cross-section of a bottle washing machine having a single immersion tank.

In both alternatives, the washing machine is comprised by a loading table 1, a pre-washing zone 2, a water draining zone 3, a heat exchange zone 4, between the bottle containers 5 and the washing solution 6, a bactericidal treatment zone 7, a thermal recovery zone 8, between containers bearing bottles 5 and the solution 6, a washing solution draining zone 9, a rinsing zone 10 and an unloading zone 11.

The operating cycle of these alternatives does not differ, from the mechanical viewpoint, from that of any known washing machine, wherein bottle 12 on loading table 1 is introduced into containers 5 and conveyed thereby through the machine up to the unloading zone.

The basic novelty consists in the forced circulation, by means of pump 13, of the caustic solution countercurrent the movement of containers 5, from the outlet thereof adjacent the pre-rinsing zone 10, and the inlet thereof close to the pre-washing zone 2, thus forming two heat exchangers between containers 5 and the caustic solution 6; one for heating the bottles 12 before their inlet to zone 7 for treating and cooling solution 6, and the other for recovering heat from the containers 5 with bottles passing to the rinsing zone 10, where they reach a temperature sensitively lower than that of zone 7, their heat being transferred to the solution 6, which transmits it to the first heat exchanger in zone 4.

Figure 2:
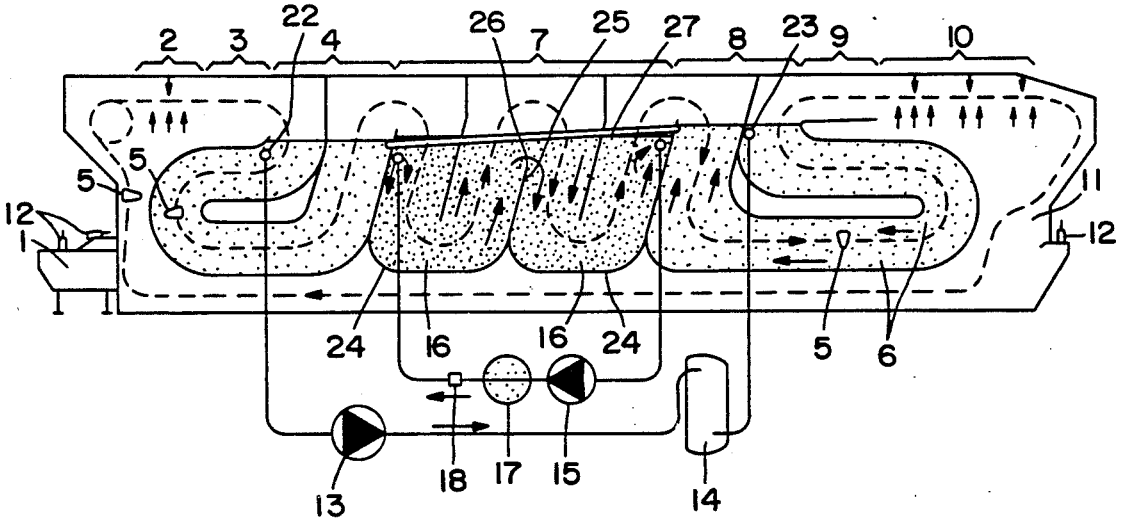
FIG. 2 is a longitudinal section of a bottle washing machine having four immersion tanks.

This new system reduces to a minimum the thermal change when bottles enter and exit from the machine and, particularly, at the treatment zone 7. Further, the system saves more than 25% of the heat energy consumed by the machine as compared to that required by known washing machines having the same production capacity.

in the example of FIG. 2, a sand filter 14 is shown at the outlet of pump 13 the function of which is retaining particles suspended in solution 6, towards the suction of pump 13 in order that the solution be free of impurities when entering again to the machine.

An additional feature of the improvements shown in the figures is the inclusion of forced circulation, by means of pump 15, of the caustic solution 16 which is at the bactericidal treatment zone 7, causing it to pass through heater 17 to be heated at the desired temperature which is automatically regulated by means of a temperature controller 18, located at the outlet of heater 17.

This circulation system for solution 16 allows maintaining its temperature within narrow ranges in the whole treatment zone 7, thus assuring its effectiveness, the larger the pump flow rate, the smaller the temperature variation at the treatment zone 7.

In the washing machine of FIG. 1, having a single tank, the treatment zone 7 is limited within the tank between the unloading zone 19 and the inlet zone 20 of pump 15, the high temperature of this zone being maintained by means of an intense circulation of solution 16 causing a flow indicated by arrows 21, in full line, in the same direction of the advance movement of containers 5 (in phanthom). The heating zone 4 is thus formed, between inlet 22 of pump 13 and outlet 19 of pump 15, and the heat recovery zone, between inlet 20 of the same pump 15 and the discharge 23 of the pump 13.

In FIG. 2, the high temperature zone 7 is formed by the two central tanks 24, the partition of which 23 has its upper edge 26 at a level lower than that of solution 16, thus permitting circulation of the solution as indicated by arrows 21.

Thermal recovery 8 and heating 4 zones are joined by conduit 27 conveying the caustic solution from one to the other by means of level difference when pump 13 is operating, transferring the solution from the first to the last tank.

The sand filter 14 mounted at the outlet of pump 13 retains particles suspended into the solution 6, thus keeping it clean, whereby the effective useful life thereof is considerably increased, with the resulting economy in washing agent consumption.

The above improvements may be applied to washing machines having a higher number of tanks, the heating zones 4 or the thermal recovery zones 8, or both of them, being formed with two or more contiguous tanks communicated between each other above the partition, as indicated in FIG. 2 for zone 7.

I claim:

1. Washing machine for bottles which comprises: independent containers housing said bottles; a conveyor for transporting said containers with bottles in a single direction; washing means having an inlet and an outlet and including at least one bottle immersion tank containing a washing solution traversed by said conveyor; said washing means including a middle zone having washing solution heating elements, and zones before and after said heated zone constituting a single pump displacement hydraulic circuit from the outlet to the inlet; and wherein (1) countercurrent thermal exchange is established from the inlet to said heated zone between the washing solution and the conveyor for the progressive heating of the bottles, and (2) a second thermal exchange is established from the heated zone to the outlet between the conveyor and washing solution for thermal recovery of the solution and progressive cooling of the bottles.

2. Washing machine according to claim 1 including greater than one immersion tank, with said tanks being positioned in succession.

3. Washing machine according to claim 2 wherein the inlet zone to the rear immersion tank and the outlet zone of the heated zone of high temperature washing solution are hydraulically interconnected by means of a conduit the ends of which are below the liquid level of the respective tanks.

4. Washing machine according to claim 1 wherein the middle zone has a high temperature washing solution immersion zone into which the washing solution is propelled by a pump through a heater and circulates in a manner selected from the group consisting of countercurrent and in the same direction, with respect to the containers with bottles immersed therein.

5. Washing machine according to claim 4 having a single immersion tank in which a high temperature washing solution immersion zone is formed at the central part thereof between the suction portion of said pump feeding an outer heater and another location towards the inlet of the tank where the heater is located, thus limiting a zone in which displacement has the same forward direction as that of the containers with bottles.

6. Washing machine according to claim 1 wherein a sand filter is mounted between a washing solution circulation pump and the middle zone.

7. Washing machine according to claim 1 including a pre-washing zone and a draining zone upstream of the middle zone and a rinsing zone and an unloading zone downstream of the middle zone.

8. Washing machine according to claim 7 wherein said middle zone includes a bactericidal treatment zone.

* * * * *